US011047269B2

(12) United States Patent
Von Gaisberg-Helfenberg et al.

(10) Patent No.: US 11,047,269 B2
(45) Date of Patent: Jun. 29, 2021

(54) VALVE TRAIN DEVICE

(71) Applicant: Daimler AG, Stuttgart (DE)

(72) Inventors: Alexander Von Gaisberg-Helfenberg, Beilstein (DE); Markus Lengfeld, Leutenbach (DE); Jens Meintschel, Bernsdorf (DE); Thomas Stolk, Kirchheim (DE)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 16/469,513

(22) PCT Filed: Sep. 20, 2017

(86) PCT No.: PCT/EP2017/001115

§ 371 (c)(1),
(2) Date: Jun. 13, 2019

(87) PCT Pub. No.: WO2018/108297

PCT Pub. Date: Jun. 21, 2018

(65) Prior Publication Data

US 2020/0116050 A1 Apr. 16, 2020

(30) Foreign Application Priority Data

Dec. 14, 2016 (DE) ..... 10 2016 014 872.1

(51) Int. Cl.
*F01L 13/00* (2006.01)
*F01L 1/047* (2006.01)

(52) U.S. Cl.
CPC ..... *F01L 13/0036* (2013.01); *F01L 1/047* (2013.01); *F01L 13/0063* (2013.01);
(Continued)

(58) Field of Classification Search
CPC ..... F01L 13/0036; F01L 1/047; F01L 1/053; F01L 1/267; F01L 2001/0473; F01L 2013/0052; F01L 2013/10
(Continued)

(56) References Cited

U.S. PATENT DOCUMENTS

2011/0079191 A1* 4/2011 Lengfeld ..... F01L 1/053 123/90.18
2013/0255607 A1* 10/2013 Schuler ..... F01L 13/0036 123/90.11
(Continued)

FOREIGN PATENT DOCUMENTS

DE 198 33 621 A1 1/2000
DE 10 2007 061 353 A1 6/2009
(Continued)

OTHER PUBLICATIONS

PCT/EP2017/001115, International Search Report dated Dec. 21, 2017 (Three (3) pages).

*Primary Examiner* — Devon C Kramer
*Assistant Examiner* — Kelsey L Stanek
(74) *Attorney, Agent, or Firm* — Crowell & Moring LLP

(57) ABSTRACT

A valve train device, in particular for an internal combustion engine, includes a support element secured to a housing, at least one axially moveable cam unit associated with a valve, and at least one switch unit for axially moving at least one part of the cam unit having at least one displacement body which is provided to be introduced for axial movement at least functionally between the support element and the cam unit. The cam unit has at least three cam paths.

4 Claims, 3 Drawing Sheets

(52) U.S. Cl.
CPC ..... *F01L 2001/0473* (2013.01); *F01L 2013/0052* (2013.01); *F01L 2013/0078* (2013.01)

(58) Field of Classification Search
USPC ..... 123/90.31, 90.16, 90.18, 90.27
See application file for complete search history.

(56) References Cited

U.S. PATENT DOCUMENTS

| | | | | |
|---|---|---|---|---|
| 2015/0233271 | A1* | 8/2015 | Popp | F01L 13/0036 123/90.18 |
| 2015/0308302 | A1* | 10/2015 | Popp | F01L 1/344 123/90.18 |
| 2017/0284240 | A1* | 10/2017 | Takada | F01L 1/053 |

FOREIGN PATENT DOCUMENTS

| | | | | |
|---|---|---|---|---|
| DE | 10 2012 022 555 | A1 | 5/2014 | |
| DE | 102012022555 | A1 * | 5/2014 | F01L 13/0036 |
| DE | 10 2012 111 855 | A1 | 6/2014 | |
| DE | 10 2015 014 175 | A1 | 5/2017 | |
| JP | 2014-152642 | A | 8/2014 | |
| JP | 2015-214937 | A | 12/2015 | |
| JP | 2015214937 | A * | 12/2015 | |

* cited by examiner

VALVE TRAIN DEVICE

BACKGROUND AND SUMMARY OF THE INVENTION

The invention relates to a valve train device and to a method for operating a valve train device.

A valve train device is already known from DE 10 2015 014 175, in particular for an internal combustion engine, comprising a support element secured to the housing and comprising at least one axially shiftable cam unit that is associated with a valve and comprising at least one switch unit for axially shifting at least part of the cam unit, which comprises at least one displacement body, which is provided so as to displace at least part of the cam unit for axial shifting.

The object of the invention in particular is to provide a valve train device having an advantageously variable means for switching a cam unit using a displacement principle.

The invention proceeds from a valve train device, in particular for an internal combustion engine, comprising a support element secured to the housing and comprising at least one axially shiftable cam unit that is associated with a valve and comprising at least one switch unit for axially shifting at least part of the cam unit, which comprises at least one displacement body, which is provided so as to be introduced for axially shifting at least operatively between the support element and the cam unit.

It is proposed that the cam unit has at least three cam tracks. As a result, it can be particularly advantageous to provide a valve train device which can be switched using a displacement principle and which is of a particularly variable design. A "support element secured to the housing" is to be understood in particular to mean an element, for example bearing points for a camshaft, which is securely connected to a housing of the valve train device. In principle, it is also conceivable that the support element secured to the housing is designed to be part of the housing of the valve train device. A "cam unit" is to be understood in particular to mean a unit of at least one cam element, in which a cam element is arranged non-rotatably and preferably so as to axially shift on a camshaft and is provided, in order to actuate a valve, to subject the corresponding valve directly or indirectly to at least one valve lift. For this purpose, a cam element has at least one cam track, preferably a plurality of cam tracks. A cam unit for actuating a valve preferably has a cam element comprising a plurality of, preferably in particular three, different cam tracks. Particularly advantageously, a cam unit for actuating two valves of a cylinder has a cam element, in each case having a plurality of cam tracks arranged in groups for actuating each of the valves. In principle, it is also conceivable that a cam unit for actuating a valve has a plurality, preferably at least three, cam elements each having a cam track for actuating the valve. A "camshaft" is to be understood in particular to mean a shaft which is provided for actuating a plurality of valves of the internal combustion engine and in each case has at least one cam track for actuating a valve. It is also conceivable that the camshaft is designed as an intake camshaft and is provided to actuate intake valves, and that the camshaft is designed as an exhaust camshaft and is provided to actuate exhaust valves. In principle, it would also be conceivable that the camshaft is provided for actuating intake valves and for actuating exhaust valves. A "cam track" is to be understood in particular to mean a region that extends around a circumference of the camshaft, preferably around a circumference of a cam element, which region forms a valve actuation curve for valve actuation and/or which defines the valve actuation. A "switch unit" is to be understood in particular to mean a unit which is provided to shift at least part of a cam unit, preferably the entire cam unit, axially on the camshaft in order to bring different cam tracks of the cam element into engagement with the corresponding valve. The switch unit preferably has an actuator and a coupling element connected to the actuator and to the cam element to be adjusted. The coupling element is preferably designed as a displacement body. An "actuator" is to be understood in particular to mean a mechatronic component which is provided to convert electrical and/or electronic signals into a movement, in particular into a rotary and/or linear movement. In this case, an actuator is preferably designed as a spindle drive, a pneumatic piston, a hydraulic piston or as another actuator that a person skilled in the art deems appropriate. As a result, the switch unit is provided in particular to axially shift the cam unit. In this case, the switch unit is preferably controlled by a control and/or regulating unit. In particular, "provided" is understood to mean specifically designed, equipped and/or arranged. A "control and/or regulating unit" is to be understood in particular to mean a unit having at least one electronic controller. An electronic "controller" is to be understood in particular as meaning a unit having a processor unit and a memory unit and having an operating program stored in the memory unit. In principle, the control and/or regulating unit may have a plurality of interconnected controllers, which are preferably provided so as to communicate with one another via a bus system, in particular a CAN bus system. Depending on further design, the control and/or regulating unit may also have hydraulic and/or pneumatic components, in particular valves.

A "displacement body" is to be understood to mean in particular a body which displaces another element in a switching direction by means of a movement in an actuating direction, the switching direction preferably being different from the actuating direction. Particularly advantageously, the switching direction is orthogonal to the actuating direction.

It is further proposed that the at least one displacement body is provided to be adjusted so as to shift the cam unit to the third cam track. As a result, the third cam track can particularly advantageously be switched by means of the one displacement body.

It is further proposed that the switch unit has at least two displacement bodies which are provided so as to be separated from the cam unit at the same time in a switch preparation for activating and/or deactivating the third cam track. As a result, a switching of the switch unit to the third cam track can be prepared in a particularly simple manner. In this case, "activating a cam track" is to be understood in particular to mean a switching process which brings the corresponding cam track into engagement with the valve to be actuated. In this case, "deactivating a cam track" is to be understood in particular to mean a switching process which moves the corresponding cam track out of engagement with the valve to be actuated. In this case, "separated from the cam track at the same time" should be understood to mean, in particular, that the two displacement bodies are not in direct contact with the cam unit, at least for a defined period of time.

It is furthermore proposed that the valve train device has at least one shifting element which is provided to adjust at least part of the switch unit axially with respect to the support element. As a result, the switch unit together with the two displacement bodies thereof can advantageously be used for switching the three cam tracks. A "shifting element" is to be understood to mean, in particular, an element which has at least one actuator for shifting another element, in particular the switch unit, by means of which actuator the element can be axially shifted between at least two switch positions. In this case, the actuator of the shifting element is preferably designed as an actuator that a person skilled in the art deems appropriate, in particular as a spindle drive having an electric motor. In principle, it is also conceivable that the actuator is designed as a pneumatic or hydraulic actuator.

It is also proposed that the at least one shifting element is arranged inside the switch unit. As a result, the shifting element and the switch unit can be particularly advantageously formed integrally with each other, as a result of which they can be arranged particularly easily in the housing of the valve train device.

It is additionally proposed that the at least one shifting element is provided to axially shift the at least one displacement element inside the switch unit. As a result, the shifting element can be designed to be particularly advantageous and operationally reliable.

It is furthermore proposed that the at least one shifting element is arranged inside the switch unit. As a result, the shifting element can be designed to be particularly cost-effective.

It is additionally proposed that the at least one shifting element is provided to axially shift the entire switch unit. As a result, an adjustment of the switch unit between a first switch position and a second switch position can be carried out particularly easily.

Further advantages can be found in the following description of the drawings. Two embodiments of the invention are shown in the drawings. The drawings, the description of the drawings and the claims contain numerous features in combination. A person skilled in the art will expediently also consider the features individually and combine them to form appropriate further combinations.

DETAILED DESCRIPTION OF THE DRAWINGS

FIGS. 1 to 5 are schematic representations of a valve train device according to the invention. The valve train device is part of an internal combustion engine (not shown in more detail). The internal combustion engine is designed as a motor vehicle internal combustion engine, which is provided to convert chemical energy into kinetic energy, which is used in particular for propulsion of a motor vehicle. The internal combustion engine in this case has a plurality of cylinders, each having a plurality of valves 16, 17. The internal combustion engine has two valves 16, 17 designed as intake valves and two valves designed as exhaust valves. In principle, it is also conceivable that the internal combustion engine has a different number of valves 16, 17. The valves 16, 17 are shown schematically by their actuation level in FIG. 1-5.

Figure 1:
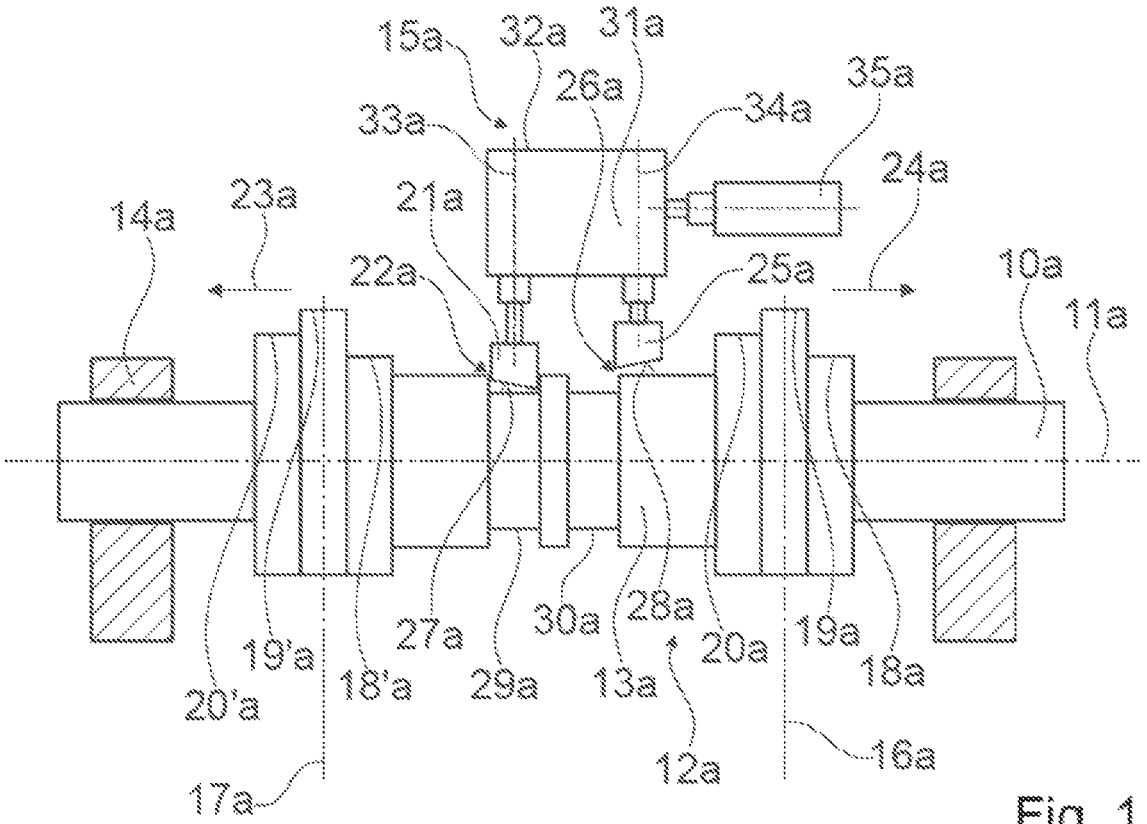
FIG. 1 is a schematic representation of a valve train device according to the invention in a first embodiment comprising a cam unit in a second switch position.

The valve train device is provided for actuating the valves 16, 17 of the internal combustion engine. The valve train device has a camshaft 10 for actuating the valves 16, 17. In FIG. 1, only a part of the camshaft 10 that is associated with a cylinder is shown. The camshaft 10 is mounted in a support element 14 that is secured to the housing. In principle, it is also conceivable that the support element 14 is designed as a housing of the valve train device. Furthermore, the valve train device has a further camshaft which is not shown in more detail. The camshaft 10 shown is designed, by way of example, as an intake camshaft and the camshaft which is not shown in more detail as an exhaust camshaft. In the following, only the part of the camshaft 10 described in FIG. 1 will be described in more detail. The description can be transferred to the part of the camshaft 10 not shown in more detail and to the camshaft not shown in more detail.

The camshaft 10 is rotatably mounted in a valve train housing which is not shown in more detail. The camshaft 10 is mounted so as to rotate about a rotational axis 11. The rotational axis 11 of the camshaft 10 is oriented so as to be substantially parallel to a rotational axis of a crankshaft of the internal combustion engine. The camshaft 10 is driven by means of a coupling (not shown in more detail) of the crankshaft. The valve train device comprises one cam unit 12 per cylinder. In principle, it is also conceivable that the valve train device has a different number of cam units 12 per cylinder. The cam unit 12 is formed by a cam element 13. In principle, it is also conceivable that the cam unit 12 is formed by a plurality of cam elements 13.

The cam element 13 is arranged so as to be axially shiftable on the camshaft 10. In this case, the cam element 13 is coupled to the camshaft 10 for conjoint rotation. The cam element 13 is connected to the camshaft 10 in particular by means of teeth (not shown in more detail). The cam element 13 is provided for actuating the valves 16, 17. The cam element 13 has three cam tracks 18, 19, 20, 18', 19', 20' for each valve 16, 17. In principle, it is also conceivable that the cam element 13 has only two or more than three cam tracks 18, 19, 20, 18', 19', 20' for each valve 16, 17. The cam tracks 18, 19, 20, 18', 19', 20' each have different contours and thus actuate the relevant valve 16, 17 with correspondingly different valve lifts. In a first switch position of the cam element 13, the first cam tracks 18, 18' actuate the relevant valve 16, 17. In a second switch position of the cam element 13, the second cam tracks 19, 19' actuate the relevant valve 16, 17. In a third switch position of the cam element 13, the third cam tracks 20, 20' actuate the relevant valve 16, 17. The actuation of a valve 16, 17 by a cam track 18, 19, 20, 18', 19', 20' takes place in a manner known to a person skilled in the art.

In order to adjust the cam element 13 on the camshaft 10 between the three switch positions, the valve train device has a switch unit 15. The switch unit 15 is provided to shift the cam element 13 axially on the camshaft 10 in order to bring the different cam tracks 18, 19, 20, 18', 19', 20' into engagement with the relevant valve 16, 17. In this case, the switch unit 15 is provided to adjust the cam element 13 between the switch positions using a displacement principle. The switch unit 15 is provided to adjust the cam element 13 by means of a displacement, in particular orthogonally to an actuating direction of the switch unit 15.

The switch unit 15 comprises a displacement body 21 for axially shifting the cam element 13 in a first switching direction 23. The displacement body 21 is provided to displace at least part of the cam unit 12 in order to axially shift the cam unit 12. In order to axially shift the cam element 13, the displacement body 21 is provided to be introduced operatively between the support element 14 and the cam element 13. The displacement body 21 has a width which corresponds to a shift path of the cam element 12 between two switch positions of immediately adjacent cam tracks 18, 19, 20, 18', 19', 20'. The width of the displacement body 21 corresponds to a width of a cam path 18, 19, 20, 18', 19', 20'. The cam element 13 forms a displacement contour 22, which is designed so as to correspond to the displacement body 21. The displacement contour 22 is provided so that the displacement body 21 for adjusting the cam element 13 comes into frictional contact therewith. The displacement contour 22 is designed as an edge of a groove 29 in the cam element 13. In this case, the circumferential groove 29 has a width that corresponds to the width of the displacement body 21. The displacement body 21 has an oblique contact surface 27. When the displacement body 21 operatively slides in, the oblique contact surface 27 of the displacement body 21 touches the cam element 13 first. The displacement body 21 has a wedge shape which forms the oblique contact surface 27. When the displacement body 21 slides in toward the cam element 13 in the radial direction, the oblique contact surface 27 engages laterally against the displacement contour 22 of the cam element 13. When the displacement body 21 slides in further, the cam element 12 slides off the oblique contact surface 27 and is shifted by the displacement body 21 in the first switching direction 23. In a switching process, the oblique contact surface 27 of the displacement body 25 is pressed against the displacement contour 22 of the cam element and thereby displaces the cam element 13 in one of the first switching directions 23.

The switch unit 15 comprises a further displacement body 25 for axially shifting the cam element 13 in a second switching direction 24. The second switching direction 24 is opposite to the first switching direction. The displacement body 25 is provided to displace at least part of the cam unit 12 for axial displacement of the cam unit 12. In order to axially shift the cam element 13, the displacement body 25 is provided to be introduced operatively between the support element 14 and the cam element 13. The displacement body 25 has a width which corresponds to a shift path of the cam element 12 between two switch positions, of immediately adjacent cam tracks 18, 19, 20, 18', 19', 20'. The width of the displacement body 25 corresponds to a width of a cam path 18, 19, 20, 18', 19', 20'. The cam element 13 forms a second displacement contour 26, which is designed so as to correspond to the displacement body 25. The displacement contour 26 is provided so that the displacement body 25, in order to adjust the cam element 13, comes into frictional contact therewith in the second switching direction 24. The displacement contour 26 is designed as an edge of a groove 30 in the cam element 13. In this case, the circumferential groove 30 has a width that corresponds to the width of the displacement body 25. The displacement body 25 has an oblique contact surface 28. When the displacement body 25 operatively slides in, the oblique contact surface 28 of the displacement body 25 touches the cam element 13 first. The displacement body 25 has a wedge shape which forms the oblique contact surface 28. In this case, the oblique contact surface 28 of the second displacement body 25 is mirror-symmetrically oriented with respect to the oblique contact surface 27 of the first displacement body 21. In a switching process, the oblique contact surface 28 of the displacement body 25 is pressed against the displacement contour 22 of the cam element and thereby displaces the cam element 13 in one of the second switching directions 24.

In an operating state in which the cam element 13 is not shifted axially between the switch positions thereof, the displacement bodies 21, 25 each form a thrust bearing for the cam element 13. In designing the thrust bearing for the cam element 13, the displacement bodies 25, 26 each form axial stops for the cam element 13, in which they are arranged in the corresponding groove 29, 30 in the cam element 13. In principle, it is also conceivable that the displacement bodies 21, 25 and the corresponding displacement contours 22, 26 are designed in another way that a person skilled in the art deems appropriate. It is conceivable, for example, that the displacement contours 22, 26 are designed as ribs having an oblique contact surface. In this case, the displacement bodies 21, 25 would be designed to be correspondingly equivalent.

The displacement bodies 21, 25 are designed to be uncoupled. The displacement bodies 21, 25 are designed in particular to be switchable independently of each other. The switch unit 15 comprises an actuator 31. The actuator 31 is provided for actuating the two displacement bodies 21, 25. The switch unit 15 comprises an actuator 32. The actuator 31 of the switch unit 15 is arranged inside the housing. The displacement bodies 21, 25 are mounted so as to be shiftable in the housing 32. The displacement bodies 21, 25 can be shifted linearly in a radial direction. In a state in which the displacement bodies 21, 25 are operatively introduced into the cam element 13, the displacement bodies 21, 25 are accommodated 60 percent in the housings 31, 32. In order to adjust the displacement bodies 21, 25, the actuator 31 comprises two switch actuators 33, 34 for radially moving the displacement bodies 21, 25. The switch actuators 33, 34 are schematically indicated by the respective switching directions thereof, which each extend in the radial direction. The switch actuators 33, 34 are designed as actuators that a person skilled in the art deems appropriate. The switch actuators 33, 34 are provided to adjust the displacement bodies between two switch positions. In a first switch position, the displacement bodies 21, 25 engage the corresponding displacement contour 22, 26 of the cam element 13. In a second switch position, the displacement bodies 21, 25 are spaced apart from the corresponding displacement contour 22, 26 of the cam element 13.

Figure 2:
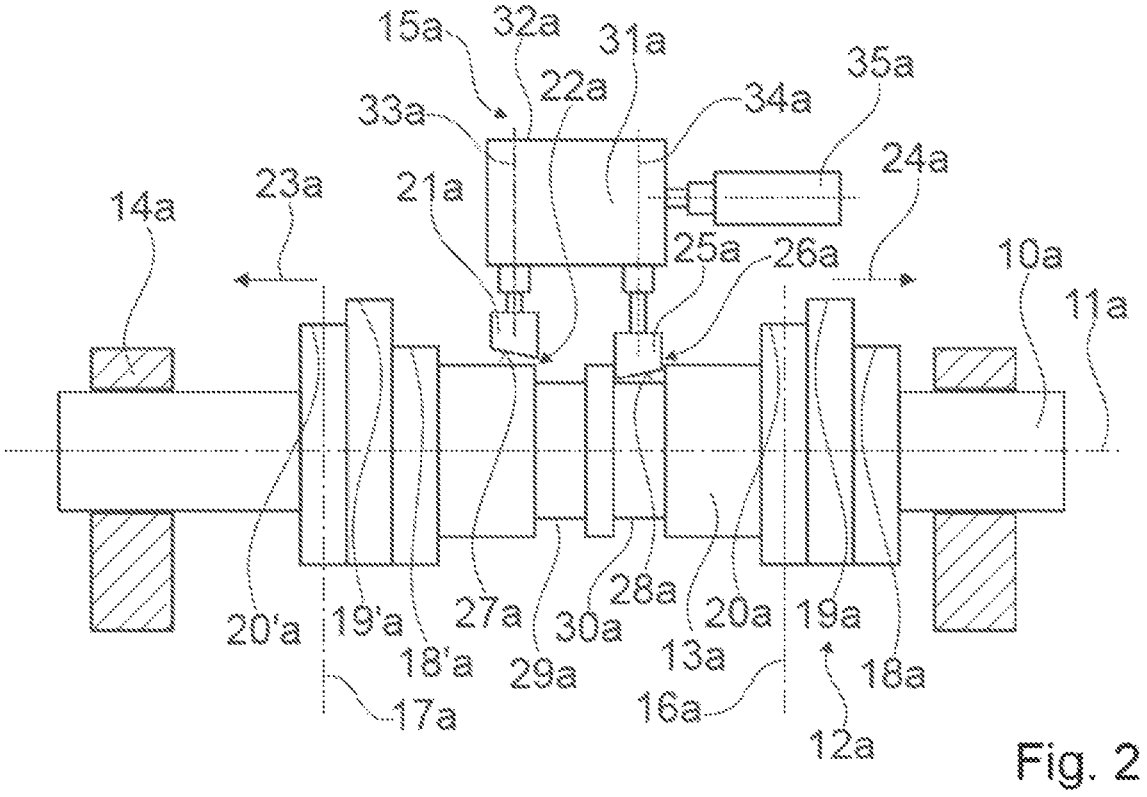
FIG. 2 is a schematic representation of the valve train device comprising the cam unit in a third switch position.
Figure 3:
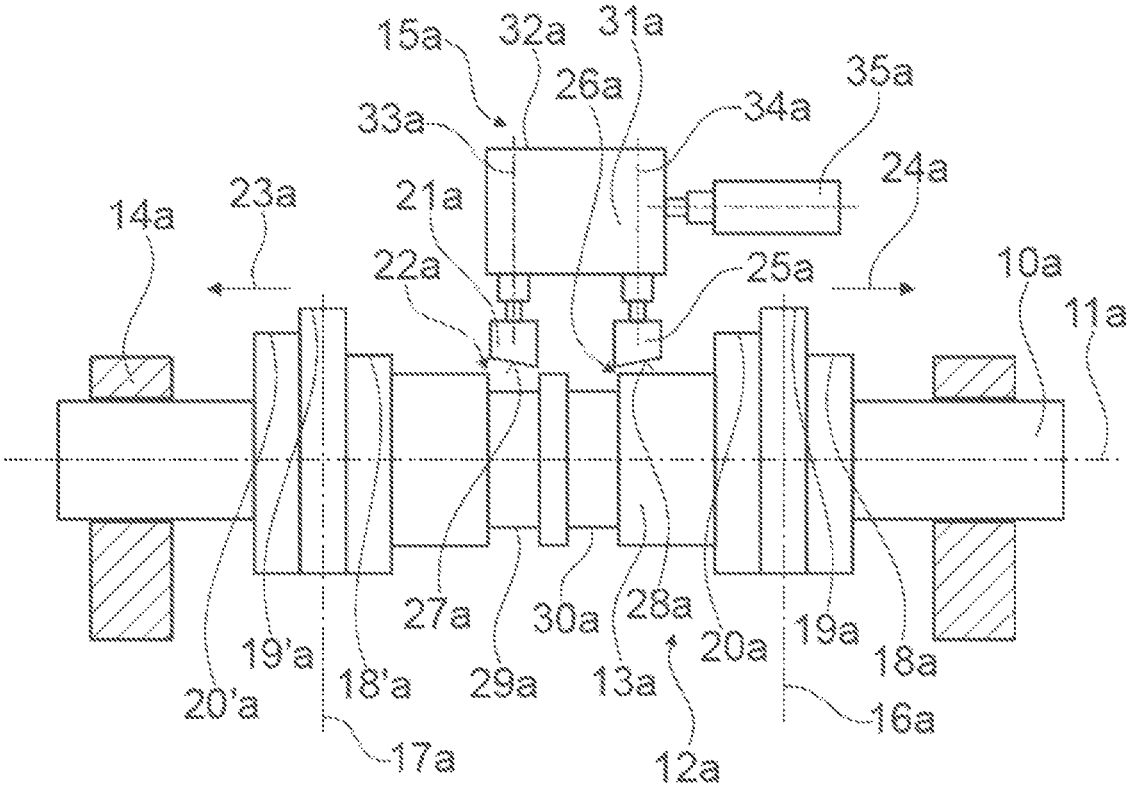
FIG. 3 is a schematic representation of the valve train device comprising the cam unit in a second switch position together with a switch unit in an intermediate position.
Figure 4:
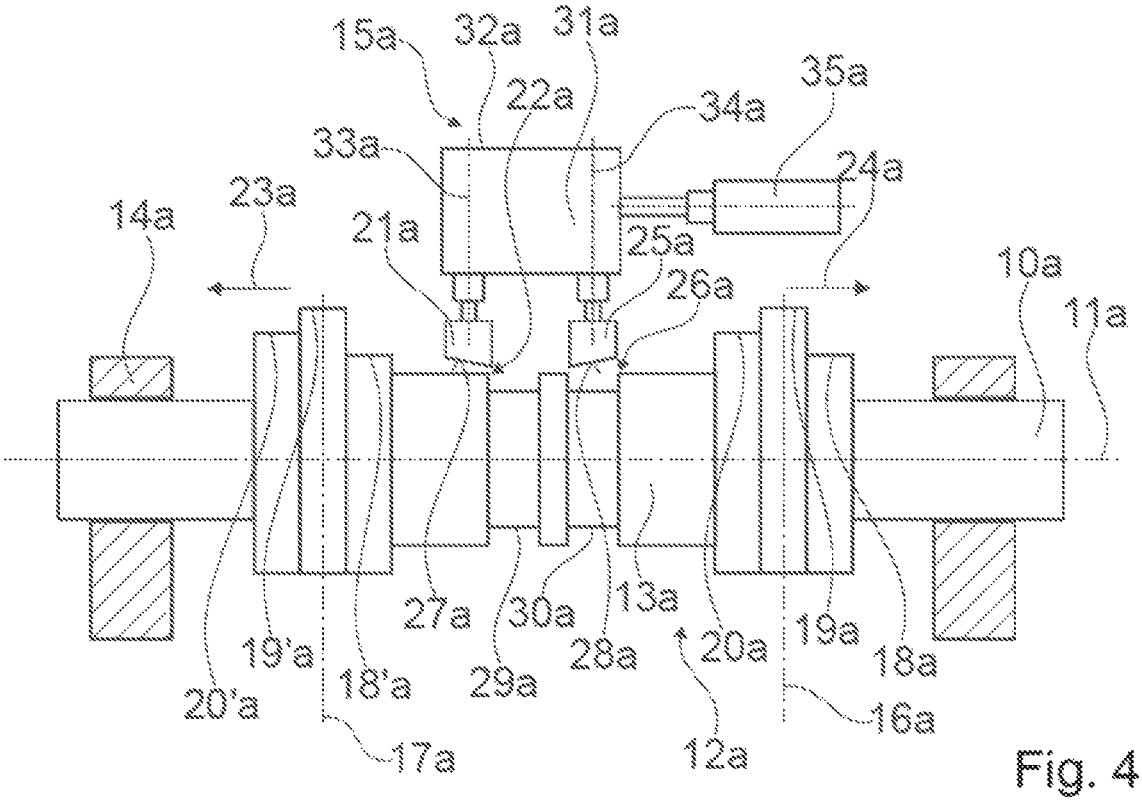
FIG. 4 is a schematic representation of the valve train device comprising the cam unit in a second switch position together with the switch unit in a second switch position.
Figure 5:
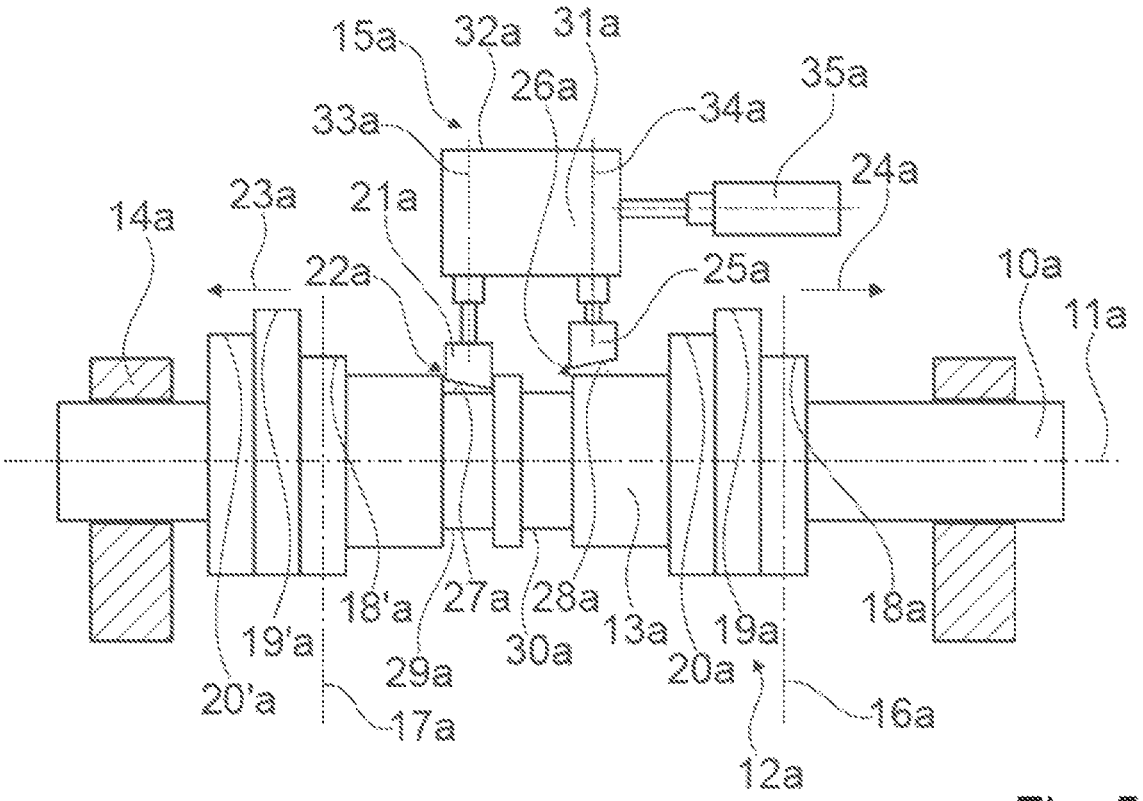
FIG. 5 is a schematic representation of the valve train device comprising the cam unit in a first switch position together with the switch unit in the second switch position.

The valve train device has a shifting element 35. The shifting element 35 is provided to adjust at least part of the switch unit 15 axially with respect to the support element 14. The shifting element 35 is provided in particular to axially adjust the entire switch unit 15. For this purpose, the switch unit 15 is mounted in the housing of the valve train device so as to be axially shiftable. The switch unit 15 is mounted in the housing of the valve train device by means of a mounting unit (not shown in more detail). The switch unit 15 is mounted so as to be shiftable between two switch positions. FIGS. 1 to 3 show a first switch position of the switch unit 15. FIGS. 4 to 5 show a second switch position of the switch unit 15. For the purpose of switching, the switch unit 15 is provided so as to be axially shifted onto an outer cam track 18, 18', 20, 20' of the three cam tracks 18, 19, 20, 18', 19', 20'. Using the axial displacement of the switch unit 15, which can perform two mutually opposite switching movements by means of its two displacement bodies 21, 25, a third switch position of the cam element 13 can be achieved. The shifting element 35 is designed as an actuator that comprises an axially retractable actuating lever. In this case, the actuator is designed as an electronically controllable spindle drive. In principle, it is also conceivable that the actuator is designed as a pneumatic or hydraulic actuator.

In order to adjust the cam element into a first switch position in which the third cam tracks 18, 18' engage the corresponding valve 16, 17, the two displacement bodies 21, 25 are initially switched at the same time to a retracted switch position and thus separated from the cam element 13 of the cam unit 12. As a result, an axial securing of the cam element 13 is released. Subsequently, the switch unit 15 is moved by means of the shifting element 35 in a pre-switch movement to the second switch position thereof. As a result, in order to shift the cam element 13 in the first switching direction 13, the displacement body 21 is in a position with respect to the correspondingly formed displacement contour 22 of the cam element 13, such that the contour can engage in an intended manner in order to switch the cam element 13. After the adjustment of the switch unit 15 into its second switch position, the cam element 13 is switched by introducing the displacement body 21 to the displacement contour 22 of the cam element 13 in the first switching direction 23 and thereby switched to the first switch position. In order to switch the cam element 13 between the first switch position in which the outer cam tracks 18, 18' are engaged and the third switch position of the cam element 13 in which the outer cam tracks 20, 20' are engaged, the switch unit 15 is shifted by means of the shifting element 35 in each case in a pre-switch movement axially with respect to the support element 14.

Figure 6:
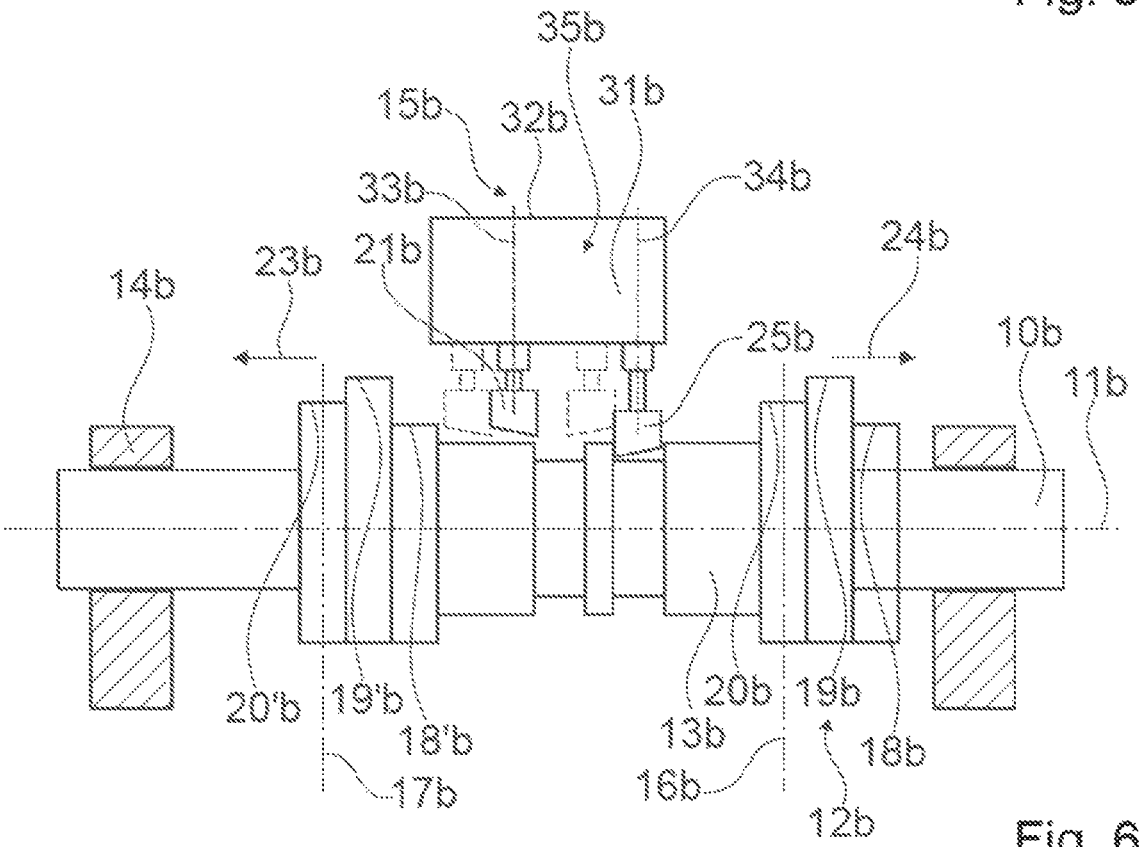
FIG. 6 is a schematic representation of a valve train device according to the invention in a second embodiment comprising a cam unit in a third switch position and a switch unit in a first switch position.

FIG. 6 shows a further embodiment of the invention. The following descriptions and the drawings are substantially restricted to the differences between the embodiments, in which, in principle, reference can also be made, with respect to identically designated components, in particular with respect to components with the same reference signs, to the drawings and/or the description of the other embodiments, in particular FIGS. 1 to 5. To distinguish the embodiments the letter "a" is placed after the reference signs of the embodiment in FIGS. 1 to 5. In the embodiments of FIG. 6 the letter "a" is replaced by the letter "b".

FIG. 6 schematically shows a valve train device according to the invention in a second embodiment. The valve train device is part of an internal combustion engine (not shown in more detail). The internal combustion engine is designed as a motor vehicle internal combustion engine, which is provided to convert chemical energy into kinetic energy, which is used in particular for propulsion of a motor vehicle. The internal combustion engine has in this case a plurality of cylinders, each having a plurality of valves 16*b*, 17*b*. The valve train device is provided for actuating the valves 16*b*, 17*b* of the internal combustion engine. The valve train device has a camshaft 10*b* for actuating the valves 16*b*, 17*b*. The camshaft 10*b* is mounted in a support element 14*b* that is secured to the housing. In principle, it is also conceivable that the support element 14*b* is designed as a housing of the valve train device. The camshaft 10*b* is mounted so as to rotate about a rotational axis 11*b*. The valve train device comprises one cam unit 12*b* per cylinder. In principle, it is also conceivable that the valve train device has a different number of cam units 12*b* per cylinder. The cam unit 12*b* is formed by a cam element 13*b*. In principle, it is also conceivable that the cam unit 12*b* is formed by a plurality of cam elements 13*b*.

The cam element 13*b* is arranged so as to be axially shiftable on the camshaft 10*b*. In this case, the cam element 13*b* is coupled to the camshaft 10*b* for conjoint rotation. The cam element 13*b* is connected to the camshaft 10*b* in particular by means of teeth (not shown in more detail). The cam element 13*b* is provided for actuating the valves 16*b*, 17*b*. For this purpose, the cam element 13*b* has three cam tracks 18*b*, 19*b*, 20*b*, 18*b*', 19', 20' per valve 16*b*, 17*b*. The cam unit 12*b* is substantially the same design as the corresponding cam unit from the first embodiment.

In order to adjust the cam element 13*b* on the camshaft 10*b* between the three switch positions, the valve train device has a switch unit 15*b*. The switch unit 15*b* comprises a displacement body 21*b* for axially shifting the cam element 13*b* in a first switching direction 23*b*. The displacement body 21*b* is provided to displace at least part of the cam unit 12 in order to axially shift the cam unit 12. The switch unit 15*b* comprises a further displacement body 25*b* for axially shifting the cam element 13*b* in a second switching direction 24*b*.

The displacement bodies 21*b*, 25*b* are designed to be uncoupled. The displacement bodies 21*b*, 25*b* are designed in particular to be switchable independently of each other. The switch unit 15*b* comprises an actuator 31*b*. The actuator 31*b* is provided for actuating the two displacement bodies 21*b*, 25*b*. The switch unit 15*b* comprises a housing 32*b*. In order to adjust the displacement bodies 21*b*, 25*b*, the actuator 31*b* comprises two switch actuators 33*b*, 34*b* for radially moving the displacement bodies 21*b*, 25*b*. The switch actuators 33*b*, 34*b* are schematically indicated by the respective switching directions thereof, which each extend in the radial direction.

The valve train device has a shifting element 35*b*. The shifting element 35*b* is provided to adjust at least part of the switch unit 15*b* axially with respect to the support element 14*b*. In contrast to the first embodiment, the shifting element 35*b* is arranged inside the housing 32*b*. The shifting element 35*b* is provided to adjust the two displacement bodies 21*b*, 25*b* inside the housing 32*b* of the switch unit 15*b*. In FIG. 6, the displacement bodies 21*b*, 25*b* are shown in a first switch position and indicated by dashed lines in a second switch position.

The invention claimed is:

1. A valve train device, comprising:

a support element secured to a housing;

an axially shiftable cam unit that is associated with a valve;

a switch unit for axially shifting the cam unit, wherein the switch unit has a first displacement body and a second displacement body;

wherein the cam unit has a first cam track, a second cam track, and a third cam track;

wherein the first cam track and the second cam track are engageable with the valve when the switch unit is in a first switch position;

wherein the first displacement body and the second displacement body are separable from the cam unit at a same time in a switch preparation for activating and/or deactivating the third cam track; and a shifting element, wherein the switch unit is axially adjustable with respect to the support element by the shifting element into a second switch position in which the third cam track is engageable with the valve.

2. The valve train device according to claim 1, wherein the shifting element is disposed inside the switch unit.

3. The valve train device according to claim 2, wherein the shifting element axially shifts the first displacement body and the second displacement body inside the switch unit.

4. The valve train device according to claim 1, wherein the shifting element is disposed outside the switch unit.

* * * * *